US008822374B2

(12) United States Patent
Stovold et al.

(10) Patent No.: US 8,822,374 B2
(45) Date of Patent: Sep. 2, 2014

(54) COLOR-CHANGING MARKING IMPLEMENT AND SUBSTRATE

(75) Inventors: Terry W. Stovold, Conshohocken, PA (US); JoAnn Domanski, Pottstown, PA (US)

(73) Assignee: Nocopi Technologies, Inc., West Conshohocken, PA (US)

( * ) Notice: Subject to any disclaimer, the term of this patent is extended or adjusted under 35 U.S.C. 154(b) by 21 days.

(21) Appl. No.: 13/344,918

(22) Filed: Jan. 6, 2012

(65) Prior Publication Data

US 2013/0178362 A1 Jul. 11, 2013

(51) Int. Cl.
*B41M 5/337* (2006.01)
*B41M 5/323* (2006.01)
*B41M 5/333* (2006.01)

(52) U.S. Cl.
CPC ..... *B41M 5/337* (2013.01); *B41M 5/323* (2013.01); *B41M 5/3333* (2013.01); *B41M 5/3335* (2013.01)
USPC ..... 503/201; 503/206

(58) Field of Classification Search
CPC .. B41M 5/323; B41M 5/3333; B41M 5/3335; B41M 5/3336; B41M 5/337
USPC ..... 503/201, 206
See application file for complete search history.

(56) References Cited

U.S. PATENT DOCUMENTS 4,084,332 A * 4/1978 Waloszyk et al. ..... 434/328
5,232,494 A 8/1993 Miller
5,460,647 A 10/1995 Snedeker et al.
5,464,470 A 11/1995 Brachman et al.
5,478,382 A 12/1995 Miller et al.
5,486,228 A 1/1996 Miller et al.
5,489,331 A 2/1996 Miller et al.
5,492,558 A 2/1996 Miller et al.
5,498,282 A 3/1996 Miller et al.
5,503,665 A 4/1996 Miller et al.
5,730,961 A 3/1998 Goudjil
RE36,306 E 9/1999 Gundjian
6,114,281 A 9/2000 Belding et al.
6,124,377 A 9/2000 Kaiser et al.
6,174,938 B1 1/2001 Miller et al.
6,271,286 B1 8/2001 Leidner et al.
6,326,332 B1 12/2001 Takayama
6,793,721 B2 9/2004 Shen et al.
8,053,494 B2 11/2011 Stovold et al.
2003/0022962 A1 1/2003 Cook et al.
2003/0082121 A1 5/2003 Borsakian et al.
2005/0075420 A1 4/2005 Stovold
2005/0165131 A1 7/2005 Stovold
2005/0275214 A1 12/2005 Pokempner et al.
2006/0236470 A1 10/2006 Sabnis et al.
2008/0113862 A1 5/2008 Stovold et al.
2009/0215621 A1 8/2009 Jackson
2010/0247223 A1 9/2010 Ribi

* cited by examiner

*Primary Examiner* — Bruce H Hess
(74) *Attorney, Agent, or Firm* — Weitzman Law Offices, LLC

(57) ABSTRACT

A color-changing marking system, including a color-changing marking medium and a substrate. The color-changing marking medium has a nominal color and includes a color developer activator and/or color former leuco dye. The substrate includes a treated portion on which a color former leuco dye and/or color developer activator has been applied. Application of the color-changing marking medium to an untreated portion of the substrate causes the color-changing marking medium to create marks of the nominal color. Application of the color-changing marking medium to the treated portion of the substrate causes the color-changing marking medium to create marks of a changed color in response to a chemical or mechanical reaction between the leuco dye and the activator. The marking medium may a crayon, colored pencil, marker ink or paint.

53 Claims, 1 Drawing Sheet

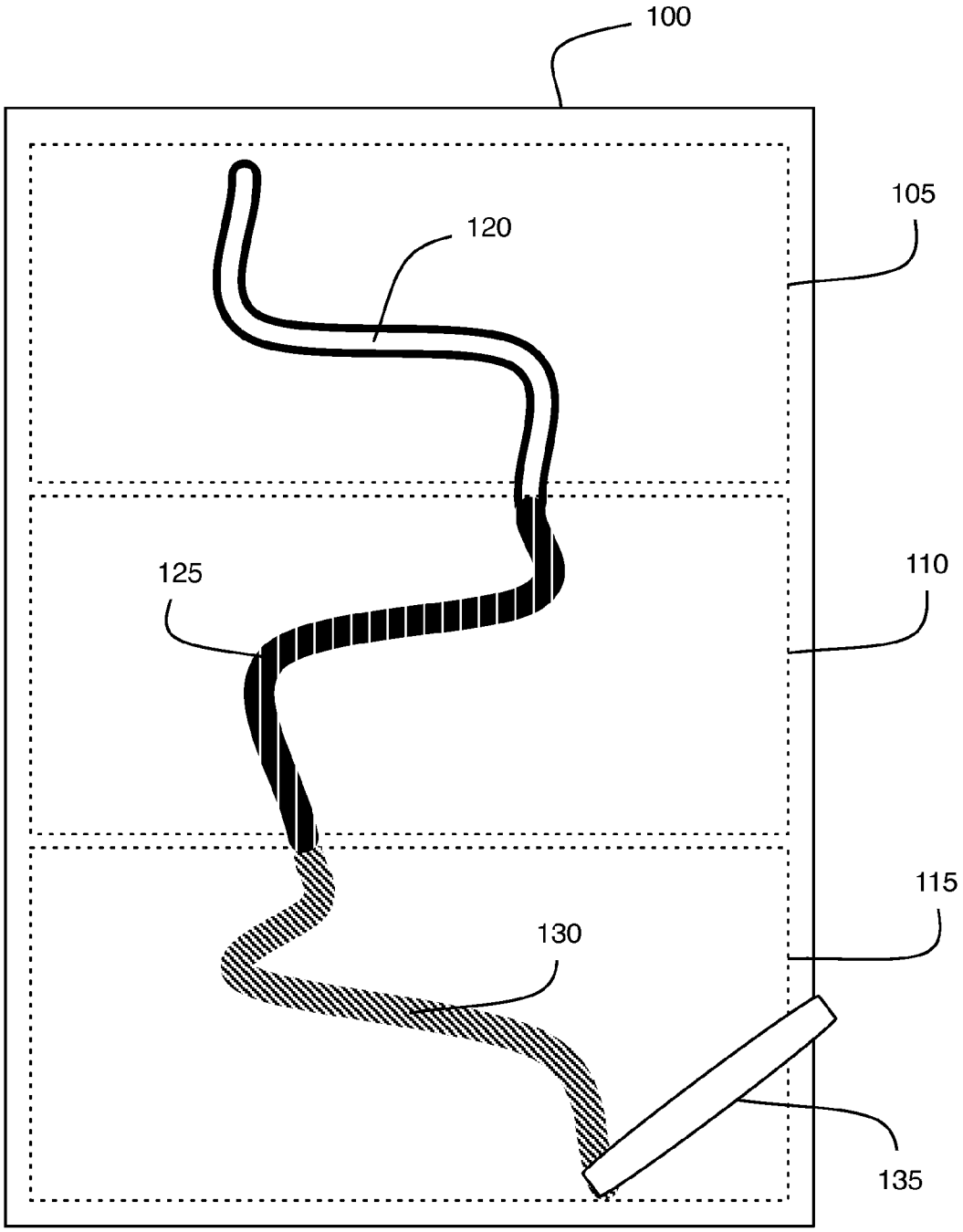
100
105
120
110
125
115
130
135

COLOR-CHANGING MARKING IMPLEMENT AND SUBSTRATE

BACKGROUND

1. Field

This disclosure relates generally to invisible color-changing ingredients in various marking devices that result in multi-colored changes when applied over a specially treated printed or coated surface.

2. Background

Invisible inks have been utilized on documents for a wide range of purposes, from anti-counterfeiting measures to games and entertainment items. Invisible inks include "scratch inks" or inks that produce a color change or color initiation by rubbing, scratching, wiping, applying pressure or other heat producing actions. Examples of invisible inks are disclosed in U.S. Pat. Nos. Re. 36,306 and 8,053,494 B1, the entire disclosures of which are incorporated herein by reference. Invisible inks may include a leuco dye color former and an activator. The combination of the leuco dye and the activator produces a color change, when combined in the presence of heat generated by, for example, rubbing, scratching, wiping, applying pressure or other heat producing actions.

BRIEF SUMMARY

In one aspect of this disclosure, a color-changing marking system includes a color-changing marking medium and a substrate. The color-changing marking medium has a nominal color and includes a color developer activator. The substrate includes a treated portion on which a color former leuco dye has been applied. Application of the color-changing marking medium to an untreated portion of the substrate causes the color-changing marking medium to create marks of the nominal color, and application of the color-changing marking medium to the treated portion of the substrate causes the color-changing marking medium to create marks of a changed color in response to a reaction between the leuco dye and the activator.

In another aspect of this disclosure, a color-changing marking system includes a color-changing marking medium and a substrate. The color-changing marking medium has a nominal color and includes a color former leuco dye. The substrate includes a treated portion on which a color developer activator has been applied. Application of the color-changing marking medium to an untreated portion of the substrate causes the color-changing marking medium to create marks of the nominal color, and application of the color-changing marking medium to the treated portion of the substrate causes the color-changing marking medium to create marks of a changed color in response to a reaction between the leuco dye and the activator.

In another aspect of this disclosure, a color-changing marking system includes a color-changing marking medium and a substrate. The color-changing marking medium has a nominal color, and includes a fully or partially solvated color developer activator and an abrasive. The substrate includes a treated portion on which a color former leuco dye and a second color developer activator have been applied. Application of the color-changing marking medium to an untreated portion of the substrate causes the color-changing marking medium to create marks of the nominal color. Application of the color-changing marking medium to the treated portion of the substrate creates marks with deeper change of color on the treated portion of the substrate in response to both heat generated and a chemical reaction between the leuco dye, the second activator, and the fully additional color developer activator.

In various embodiments, the color-changing marking medium may be, for example, a crayon, pencil, paint, ink, or nail polish.

The foregoing has outlined rather generally the features and technical advantages of one or more embodiments of this disclosure in order that the following detailed description may be better understood. Additional features and advantages of this disclosure will be described hereinafter, which may form the subject of the claims of this application.

BRIEF DESCRIPTION OF THE DRAWINGS

This disclosure is further described in the detailed description that follows, with reference to the drawings, in which:

FIG. 1 is a top plan view depicting the application of a color-changing marking medium to a specially treated substrate.

DETAILED DESCRIPTION

A color-changing marking medium, marking implement and substrate, and method for producing the same, are disclosed herein. The color-changing marking medium and substrate preferably utilize a color former leuco dye and a color developer activator. A color change can take effect when the leuco dye and activator are solubilized. Different colors may appear, depending on the specific leuco dye or different activators utilized. Either the leuco dye or the activator may be provided in a marking medium, such as (but not limited to) a specially treated crayon, pencil, marker, paint product, pen, etc. The corresponding activator, leuco dye, or both may be printed, coated or otherwise applied onto the substrate, such as (but not limited to) a sheet of paper or the like.

If an activator is provided in the marking medium, then a corresponding reactive leuco dye should be provided on at least a portion of the substrate. Conversely, if a leuco dye is provided in the marking medium, then a corresponding activator should be provided on at least a portion of the substrate. When the implement containing the marking medium (such as a crayon, pen, pencil, marker, paint product, etc.) is applied to a non-treated substrate (such as an untreated sheet of paper) or untreated portion of a substrate, the color applied will be the nominal or inherent color of the marking medium. For example, a fully or partially soluble activator-containing yellow crayon will mark yellow when applied to an untreated substrate or untreated portion of a substrate. When the marking medium implement is applied to a treated substrate (such as a leuco dye treated sheet of paper, a leuco dye and activator treated sheet of paper, or treated portion thereof), the solubility of the leuco dye with the activator or activators will cause the color of marks to change. The effects of applying the treated marking medium implement to the treated substrate are illustrated in FIG. 1.

FIG. 1 is a top plan view depicting the application of an illustrative color-changing marking medium implement 135 (e.g., a crayon) to an illustrative specially treated substrate 100 (e.g., sheet of paper). The illustrative crayon 135 may include, for example, an activator as part of its composition and have a nominal color (e.g., red). The paper sheet 100 may, for example, be prepared with three separate areas or portions 105, 110 and 115. In this example, area 105 has not been treated with a leuco dye, area 110 has been treated with a first leuco dye that produces a first color (e.g., blue) when it reacts with the activator, and area 115 has been treated with a second leuco dye that produces a second color (e.g., yellow) when it reacts with the activator.

When the illustrative crayon 135 is used on the specially treated paper 100 in the example described above, the activator contained in the crayon 135 is deposited on the paper 100. Different color effects occur within the different areas or portions 105, 110 and 115. In area 105, no color change occurs because there is no leuco dye on the paper 100 to react with the activator deposited by the crayon 135. The line 120 drawn by the crayon 135 may, for example, be red, or the nominal color of the crayon 135. In area 110, the partially or fully soluble activator deposited by the crayon 135 reacts chemically with the first leuco dye provided in area 110 of substrate 100. The resulting line 125 drawn by the crayon 135 may be, for example, blue because of the reaction between the first leuco dye and the activator. In area 115, the activator deposited by the crayon 135 reacts with the second leuco dye provided in area 115 of the substrate 100 through solubilization, causing the resulting line 130 drawn by crayon 135 to change to a yellow color. The illustrative color-changing marking medium implement 135 and substrate 100 allows for creation of color-changing crayons, colored pencils, paints, markers, pens and other writing, drawing or coloring mediums.

Multiple leuco dyes and activators may be suitable for application in the color-changing marking medium 135 and substrate 100. Examples of color forming leuco dyes suitable for use with this disclosure include Copikem 14, Copikem 6, and Copikem 4 (made by Hilton-Davis), Pergascript Orange I-5R, Pergascript Red I-6B, Pergascript Green I-3G, and Pergascript Yellow I-3R (made by Ciga-Geigy), Reakt Red 448, and Reakt Yellow 186 (made by BASF), Specialty Magenta 20, Specialty Red 747, Specialty Black 34, Specialty Magenta 16, Specialty Orange 14, Specialty Blue 1, and Specialty Yellow 37 (made by Emerald Hilton Davis), or other color formers whether or not synthetic organic coloring matter, either alone or in combination. Pergascript Blue I-2RC, Specialty Yellow 37, Specialty Cyan 39, Specialty Orange 14, EAB-F, Orange DCF (either alone or in combination with these or other leuco dyes) may be particularly suitable for use as a color forming leuco dye.

Examples of activators suitable for use with this disclosure include micronized D8 (4-hydroxy 4-isopropoxy diphenyl sulfone), and Bisphenol A (available from Sunoco), activating phenolic resins such as zincated, modified alkyphenol activator HRJ-10138, the Alkylphenol Novolac resin activator HRJ-2609 (made by Schenectady Chemicals Inc.), the chemical zinc chloride ZnCl.sub.2, some bisphenols and hydroxybenzoates, either alone or in combination. Activators such as (but not limited to) 4-(4-isoproproxyphenylsulfonyl) phenol, "4,4'-Sulfonyldiphenol", zinc salicylate, zincated phenolic resins, reactive acidic clays, o-Benzoic Sulfimide, or o-Hydroxybenzoic acid (either alone or in combination with these or other activators) may be particularly suitable for use as an activator.

Manufacture of the color-changing marking medium may involve adding an activator or leuco dye to traditional formulations for existing marking mediums. For example, an activator may be added and solubilized in a traditional nail polish formulation to create a color-changing nail polish. In some cases, however, additional ingredients or process steps may be necessary to ensure the activator or leuco dye is fully or partially solubilized within the medium of choice. For example, solvents may be necessary for manufacture of certain embodiments of the color-changing marking medium. In one embodiment, acidic clay may be used as an activator in a crayon or colored pencil embodiment of the color-changing marking medium. The acidic clay must first be fully wet in a solvent before it can be mixed with traditional colored pencil or crayon ingredients. Suitable solvents for helping fully or partially solubilize and wet out activators may include (but are not limited to) Propylene Carbonate, 2,2,4-Trimethyl 1,3 Pentanediol monisobutyrate, Disiopropyl Adipate, Dimethyl Adipate, C12-15 Alkyl Benzoate, Tri-n-butylcitrate, Octyl Palmitate, Dioctyl Sebacate, Dibutyl Sebacate, Methyl Laurate/myristate, Triethyl Citrate, Acetyl Triethyl Citrate, Acetyl Tributyl Citrate, Isopropyl Palmitate, or Stearyl Alcohol.

Illustrative examples of various embodiments of the color-changing marking medium are described below.

EXAMPLE I

Activator Containing Crayon-Type Color-Changing Marking Medium

In one embodiment, an illustrative crayon-type color-changing marking medium and corresponding method of manufacture is disclosed. Preferably, the color-changing crayon may comprise approximately 1-30% activator by weight and approximately 10-30% solvent by weight, preferably about 10-15% activator by weight of the crayon and about 15-20% solvent by weight of the crayon. The balance of the crayon may comprise standard crayon ingredients, such as waxes, pigment, coloring agent and mineral oil.

The following table sets forth the example weight percentage of the ingredients of the illustrative Example I crayon-type color-changing marking medium.

| Ingredients | Weight % (approx.) |
|---|---|
| Activator | 1-30% |
| Solvent | 10-30% |
| Crayon Ingredients | 40-89% |

The Example I color-changing crayon may be manufactured by first fully or partially solvating or wetting the activator in the suitable solvent. The mixture is then blended to a melted existing colored crayon (or standard ingredients for a crayon). The melted, blended mixture is placed in a mold to cool. Once cooled, the color-changing crayon is ready for use. Using the color-changing crayon to mark any substrate or portion thereof containing the corresponding reactive leuco dye will trigger the desired color change in the markings Using the color-changing crayon to mark any uncoated substrate or portion thereof (not containing the corresponding reactive leuco dye) will provide a marking in the original, inherent color of the crayon.

EXAMPLE II

Activator Containing Crayon-Type Color-Changing Marking Medium

In another embodiment, a second illustrative crayon-type color-changing marking medium is disclosed. The color-changing crayon in this example may include approximately 10% by weight of 4-(4-isopropoxyphenylsulfonyl) phenol activator, 19% by weight of propylene carbonate solvent, and 71% by weight of standard crayon ingredients. For example, an illustrative Example II color-changing crayon may comprise 3.5 grams of 4-(4-isopropoxyphenylsulfonyl) phenol, 6.5 grams of propylene carbonate and 9.9 grams of standard colored crayon ingredients (such as waxes, pigment, coloring agent and mineral oil).

The following table sets forth the example weight percentage of the ingredients of the illustrative Example II crayon-type color-changing marking medium.

| Ingredients | Weight (grams) | Weight % (approx.) |
|---|---|---|
| 4-(4-isopropoxyphenylsulfonyl) phenol (Activator) | 1.4 | 10% |
| Propylene Carbonate (Solvent) | 2.6 | 19% |
| Colored Crayon | 9.9 | 71% |
| TOTAL | 13.9 | 100% |

The Example II color-changing crayon may be manufactured by first adding approximately 3.5 grams of 4-(4-isopropoxyphenylsulfonyl) phenol activator to approximately 6.5 grams of Propylene Carbonate solvent. The combination is then heated to dissolve as much as possible the 4-(4-isopropoxyphenylsulfonyl) phenol in the solvent. Approximately 4 grams of the resulting mixture is then removed and added to approximately 9.9 grams of colored crayon. The combination is heated to melt the colored crayon and combine it with the 4-(4-isopropoxyphenylsulfonyl) phenol and Propylene Carbonate mixture. This mixture is then poured into a mold and allowed to cool. The resulting Example II color-changing crayon will have the same color as the original colored crayon used as an ingredient. When used with an appropriate substrate or portion thereof having a corresponding leuco dye reactive with 4-(4-isopropoxyphenylsulfonyl) phenol, the markings produced by the color-changing crayon on the substrate will change from the crayon's original color.

EXAMPLE III

Activator Containing Crayon-Type Color-Changing Marking Medium

In another embodiment, another illustrative color-changing embodiment crayon-type color-changing marking medium is disclosed. The color-changing crayon in this example may include approximately 13% by weight of acidic clay activator, such as Fulacolor XW, approximately 16% by weight of Dimethyl Adipate solvent, and 71% by weight of standard colored crayon ingredients. For example, an exemplary Example III crayon may contain approximately 1.8 grams Fulacolor XW, approximately 2.2 grams Dimethyl Adipate, and approximately 9.6 grams standard colored crayon ingredients.

The following table sets forth the example weight percentage of the ingredients of the illustrative Example III crayon-type color-changing marking medium.

| Ingredients | Weight (grams) | Weight % (approx.) |
|---|---|---|
| Fulacolor XW (Activator) | 1.8 | 13% |
| Dimethyl Adipate (Solvent) | 2.2 | 16% |
| Colored Crayon | 9.6 | 71% |
| TOTAL | 13.6 | 100% |

The Example III color-changing crayon may be manufactured by first adding approximately 4 grams of Fulacolor XW acidic clay to approximately 5 grams of Dimethyl Adipate to wet the Fulacolor XW. Approximately 4 grams of the resulting wetted mixture may be removed and added to approximately 9.6 grams of colored crayon. The ingredients are heated to melt the colored crayon and mix the ingredients. The resulting mixture is then poured into a mold and allowed to cool to form an Example III color-changing crayon. When used with an appropriate substrate or portion thereof having a corresponding leuco dye reactive with Fulacolor XW, the markings produced by the Example III crayon on the substrate will change from the crayon's original color.

EXAMPLE IV

Leuco Dye Containing Crayon-Type Color-Changing Marking Medium

In another embodiment, another illustrative crayon-type color-changing marking medium and substrate is disclosed. The color-changing crayon preferably includes leuco dye present in an amount of about 0.1% to about 5% by weight of the crayon, solvent present in an amount of about 10% to about 30% by weight of the crayon, and colored crayon ingredients present in an amount of about 65% to about 88.9% by weight of the crayon.

Specifically, in this example, the color-changing crayon may include approximately 0.2% by weight of Pergascript Red I-6B leuco dye, approximately 14.3% by weight of Tri-n-Butyl Citrate, approximately 14.3% by weight of Dimethyl Adipate, and approximately 9.8% by weight of standard colored crayon ingredients. For example, a 13.8 gram Example IV colored crayon may comprise approximately 0.04 grams Pergascript Red I-6B leuco dye, approximately 1.98 grams Tri-n-Butyl Citrate, approximately 1.98 grams Dimethyl Adipate, and approximately 9.8 grams of standard colored crayon ingredients.

The following table sets forth the example weight percentage of the ingredients of the illustrative Example IV crayon-type color-changing marking medium.

| Ingredients | Weight (grams) | Weight % (approx.) |
|---|---|---|
| Pergascript Red I-6B (Leuco Dye) | 0.04 | 0.2 |
| Tri-n-butyl Citrate (Solvent) | 1.98 | 14.3 |
| Dimethyl Adipate (Solvent) | 1.98 | 14.3 |
| Colored Crayon | 9.8 | 71.2 |
| TOTAL | 13.8 | 100% |

The illustrative Example IV colored crayon may be manufactured by first dissolving approximately 0.04 grams of Pergascript Red I-6B leuco dye into approximately 3.96 grams of a mixture comprised of 50% of Tri-n-butyl Citrate and 50% Dimethyl Adipate. Subsequently, approximately 9.8 grams of crayon may be added to the solution. The mixture may be heated until the crayon is melted. The heated mixture may then be stirred for consistency and poured into a mold while still in liquid form. The resulting color-changing crayon will have a nominal or inherent color consistent with the crayon ingredient used. The color will change when it is applied to a substrate or portion thereof having a corresponding leuco dye reactive with the Tri-n-butyl Citrate activator.

EXAMPLE V

Finger Paint-Type Color-Changing Marking Medium

In another embodiment, an illustrative color-changing finger paint-type color-changing marking medium is disclosed.

The activator and/or leuco dye may also be incorporated in finger paint. When the finger paint is applied to a substrate having a corresponding leuco dye or activator, the color will change because of the combination of leuco dye and activator, and frictional heat. Preferably, the activator is present in an amount of about 20% to about 30% by weight of the total quantity of paint, the solvent is present in an amount of about 20% to about 30% by weight of the total quantity of paint, the gellant is present in an amount of about 5% to about 10% by weight of the total quantity of paint, and colored crayon is present in an amount of about 30% to about 55% by weight of the total quantity of paint.

In this specific example, the finger paint includes approximately 27% by weight of Dimethyl Adipate solvent, approximately 27% by weight of 4-(4-isopropoxyphenylsulfonyl) phenol activator, approximately 6% by weight of Sylvaclear 1800 PE resin gellant, and approximately 40% by weight of standard colored crayon ingredients. For example, a 10 gram quantity of the Example V finger paint may comprise approximately 2.7 grams of 4-(4-isopropoxyphenylsulfonyl) phenol activator, approximately 2.7 grams of Dimethyl Adipate solvent, approximately 0.6 grams of Sylvaclear PE 1800 resin gellant, and approximately 4 grams of colored crayon ingredients.

The following table sets forth the example weight percentage of the ingredients of the illustrative Example V finger paint-type color-changing marking medium.

| Ingredients | Weight (grams) | Weight % (approx.) |
|---|---|---|
| 4-(4-isopropoxyphenylsulfonyl) phenol (Activator) | 2.7 | 27% |
| Dimethyl Adipate (Solvent) | 2.7 | 27% |
| Sylvaclear PE 1800 Resin (Gellant) | 0.6 | 6% |
| Colored Crayon | 4.0 | 40% |
| TOTAL | 10.0 | 100% |

The color-changing finger paint may be manufactured by heating approximately 2.7 grams of Dimethyl Adipate, approximately 2.7 grams of 4-(4-isopropoxyphenylsulfonyl) phenol, and approximately 0.6 grams Sylvaclear PE 1800 resin. When all solids have dissolved, approximately 4 grams of colored crayon may then be added to the mixture. Heat is continuously applied to the mixture until the crayon is melted. The resulting mixture is then mixed and allowed to cool. The resulting color-changing Example V finger paint will have a nominal or inherent color of the colored crayon used, and will change color when applied to a substrate or portion thereof that has been treated with a corresponding leuco dye reactive with the 4-(4-isopropoxyphnylsulfonyl) phenol.

EXAMPLE VI

Marker-Type Color-Changing Marking Medium

In another embodiment, an illustrative marker-type color-changing marking medium is disclosed. The leuco dye and/or activator are provided in marker ink to be used in a marker, creating a color-changing marker. Preferably, the solvent dye is present in an amount of about 0.1% to about 1.0% by weight of the marker ink, the activator is present in an amount of about 10% to about 15% by weight of the marker ink, and at least one solvent is present in an amount of about 84% to about 89.9% by weight of the marker ink.

In this specific example, the color-changing marker comprises approximately 0.5% by weight of Solvent blue 004 solvent dye, approximately 12% by weight of 4-(4-isppropoxyphenylsulfonyl) phenol activator, approximately 67% by weight of Ethanol solvent, and approximately 20.5% by weight of Isopropanol solvent. For example, the illustrative Example V color-changing marker made of the preceding ingredients may comprise approximately 0.5 grams Solvent blue 004, approximately 11.8 grams 4-(4-isopropoxyphenylsulfonyl) phenol, approximately 67.2 grams of Ethanol and approximately 20 grams of Isopropanol.

The following table sets forth the example weight percentage of the ingredients of the illustrative Example VI marker-type color-changing marking medium.

| Ingredients | Weight (grams) | Weight % (approx.) |
|---|---|---|
| Solvent blue 004 (Solvent dye) | 0.5 | 0.5% |
| 4-(4-isopropoxyphenylsulfonyl) phenol (Activator) | 11.8 | 12.0% |
| Ethanol (Solvent) | 67.2 | 67.0% |
| Isopropanol (Solvent) | 20.0 | 20.5% |
| TOTAL | 99.5 | 100% |

The illustrative Example VI color-changing marker may be manufactured by mixing approximately 0.5 grams of Solvent blue 004 with approximately 11.8 grams of 4-(4-isopropoxyphenylsulfonyl) phenol into an already extant mixture of approximately 67.2 grams of Ethanol and approximately 20 grams of Isopropanol. Once completely mixed, the resulting mixture may be dispensed into a marker. The marker will have a nominal or inherent color corresponding to the color of the Solvent blue 004. The color will change when the marker is applied to a substrate or portion thereof having a corresponding leuco dye reactive with the 4-(4-isopropoxyphenylsulfonyl) phenol.

EXAMPLE VII

Nail Polish-Type Color-Changing Marking Medium and Nail Substrate

In another embodiment, an illustrative nail polish-type color-changing marking medium and nail film is disclosed. Preferably, the color-changing nail polish may include about 5% to about 10% by weight activator and about 90% to about 95% by weight of colored solvent-based nail polish. In this specific example, the color-changing nail polish includes approximately 8% by weight of 4-(4-isopropoxyphenylsulfonyl) phenol activator and approximately 92% by weight of colored solvent-based nail polish. For example, the color-changing nail polish solution of approximately 98 grams may include approximately 8 grams of 4-(4-isopropoxyphenylsulfonyl) phenol and approximately 90 grams colored solvent-based nail polish.

The color-changing nail polish may be applied to a nail substrate, such as a fake nail or nail film that is laid on top of the actual nail. The nail substrate or portion thereof is treated with a corresponding leuco dye or activator reactive with the leuco dye or activator contained in the color-changing nail polish. On application to the substrate, a color change takes effect between the activator and leuco dye.

The following table sets forth the example weight percentage of the ingredients of the illustrative Example VII color-changing nail polish-type color-changing marking medium.

| Ingredients | Weight (grams) | Weight % (approx.) |
|---|---|---|
| 4-(4-isopropoxyphenylsulfonyl) phenol (Activator) | 8 | 8% |
| Colored solvent-based nail polish | 90 | 92% |
| TOTAL | 98 | 100% |

The illustrative Example VII color-changing nail polish may be manufactured by adding approximately 8 grams of 4-(4-isopropoxyphenylsulfonyl) phenol to approximately 90 grams of colored solvent-based nail polish. The solution is mixed until the 4-(4-isopropoxyphenylsulfonyl) phenol dissolves. The color-changing nail polish will have a nominal or inherent color of the colored solvent-based nail polish. The color will change when it is applied to a nail substrate or portion thereof having a corresponding leuco dye reactive with the 4-(4-isopropoxyphenylsulfonyl) phenol activator.

EXAMPLE VIII

Nail Polish-Type Color-Changing Marking Medium and Nail Substrate

In another embodiment, another illustrative nail polish-type color-changing marking medium and nail film is disclosed. The color-changing nail polish may be applied to a nail substrate, as described above with respect to the Example VII color-changing nail polish. The illustrative color-changing nail polish in this example may include approximately 3.6% by weight of Ethyl cellulose, approximately 20% by weight of anhydrous Isopropanol, approximately 62.6% by weight of Ethanol SDA 40B, approximately 11.8% by weight of 4-(4-isopropoxyphenylsulfonyl) phenol, 1% by weight of Rhodamine dye and 1% by weight of a scent additive. For example, a 100 gram solution of the color-changing nail polish may comprise approximately 3.6 grams of Ethyl cellulose, approximately 20 grams of anhydrous Isopropanol, approximately 62.6 grams of Ethanol SDA 40B, approximately 11.8 grams of 4-(4-isopropoxyphenylsulfonyl) phenol, approximately 1 gram of Rhodamine dye and approximately 1 gram of a scent additive.

The following table sets forth the example weight percentage of the ingredients of the illustrative Example VIII nail polish-type color-changing marking medium.

| Ingredients | Weight (grams) | Weight % (approx.) |
|---|---|---|
| Ethyl cellulose | 3.6 | 3.6% |
| Anhydrous Isopropanol | 20.0 | 20.0% |
| Ethanol SDA 40B | 62.6 | 62.6% |
| 4-(4-isopropoxyphenylsulfonyl) phenol (Activator) | 11.8 | 11.8% |
| Rhodamine dye | 1.0 | 1.0% |
| Scent additive | 1.0 | 1.0% |
| TOTAL | 100.0 | 100% |

The illustrative color-changing nail polish in this example may be manufactured by dissolving approximately 3.6 grams of Ethyl cellulose in a mixture of approximately 20 grams anhydrous Isopropanol and approximately 62.6 grams Ethanol SDA 40B. Approximately 11.8 grams of 4-(4-isopropoxyphenylsulfonyl) phenol, approximately 1 gram of Rhodamine dye and approximately 1 gram of scent additive (e.g., bubblegum scent) are then added and mixed in. The resulting color-changing nail polish will have a nominal or inherent color consistent with the Rhoadamine dye, but will change color upon application to a nail substrate or portion thereof that has been treated with a leuco dye reactive with the 4-(4-isopropoxyphenylsulfonyl) phenol activator.

In another embodiment for a color-changing crayon or colored pencil, an abrasive such as (but not limited to) silica, titanium dioxide, calcium carbonate, clay or talc, may be provided in the crayon or colored pencil formulation with or without an activator or leuco dye. The resulting abrasive-containing crayon or colored pencil will react with special substrates upon which both the activator and leuco dye have been applied due to heat from the friction of applying the abrasive-containing crayon or colored pencil to the substrate. An invisible ink containing an activator and leuco dye, such as the invisible ink disclosed in U.S. Pat. No. 8,053,494 B1, may be applied on a portion of the substrate to facilitate the color change when the abrasive-containing crayon is applied on that portion of the substrate on which the invisible ink has been applied. In one example, the abrasive-containing color-changing crayon or colored pencil having a nominal color, includes an abrasive and a fully or partially solvated color developer activator. Application of the abrasive-containing color-changing crayon or colored pencil to an untreated portion of the substrate causes the color-changing marking medium to create marks of the nominal color. Application of the color-changing marking medium to a treated portion of the substrate on which a color former leuco dye and a second color developer activator has been applied creates marks of a changed color on the treated portion of the substrate in response to both heat generated and a chemical reaction between the color former leuco dye, the second activator, and the fully or partially solvated activator.

In another embodiment for color-changing marker formulations, other colorants and solvents may be utilized with no activator or leuco dye, such as (but not limited to) Propylene Carbonate, Ethanol, Ispropanol, Dimethyl Adipate, or mixtures of these solvents. The marker ink would nevertheless react with a substrate upon which both the activator and leuco dye have been applied, because the solvents in the marker ink would solvate the activator and leuco dye, causing a color change.

Having described and illustrated the principles of this application by reference to one or more example embodiments, it should be apparent that the example embodiment(s) may be modified in arrangement and detail without departing from the principles disclosed herein and that it is intended that the application be construed as including all such modifications and variations insofar as they come within the spirit and scope of the subject matter disclosed.

What is claimed is:

1. A color-changing marking system, comprising:

a color-changing marking medium having a nominal color and including a color developer activator that is not soluble in an aqueous solvent and at least one nonaqueous solvent; and a substrate having a treated portion on which a color former leuco dye has been applied;

wherein application of the color-changing marking medium to an untreated portion of the substrate causes the color-changing marking medium to create marks of the nominal color, and application of the color-changing marking medium to the treated portion of the substrate causes the color-changing marking medium to create marks of a changed color in response to a reaction between the leuco dye and the activator.

2. The system of claim 1, wherein the color-changing marking medium is a crayon.

3. The system of claim 2, wherein the activator is present in an amount of about 1% to about 30% by weight of the crayon and the solvent is present in an amount of about 10% to about 30% by weight of the crayon.

4. The system of claim 3, wherein the activator is present in an amount of about 10% to about 15% by weight of the crayon, and the solvent is present in an amount of about 15% to about 20% by weight of the crayon.

5. The system of claim 4, wherein the activator is present in an amount of about 10% by weight of the crayon, and the solvent is present in an amount of about 19% by weight of the crayon.

6. The system of claim 5, wherein the activator is 4-(4-isopropoxyphenylsulfonyl)phenol and the solvent is propylene carbonate.

7. The system of claim 4, wherein the activator is present in an amount of about 13% by weight of the crayon, and the solvent is present in an amount of about 16% by weight of the crayon.

8. The system of claim 7, wherein the activator is Fulacolor XW and the solvent is dimethyl adipate.

9. The system of claim 1, wherein the marking medium is a colored pencil.

10. The system of claim 9, wherein the marking medium includes solvent for solvating the activator in the colored pencil.

11. The system of claim 1, wherein the marking medium is a colored paint.

12. The system of claim 11, wherein the paint includes solvent and gellant.

13. The system of claim 12, wherein the activator is 4-(4-isopropoxyphenylsulfonyl)phenol, the solvent is dimethyl adipate, and the gellant is Sylvaclear PE 1800 resin.

14. The system of claim 12, wherein the activator is present in an amount of about 20% to about 30% by weight of the total quantity of paint, the solvent is present in an amount of about 20% to about 30% by weight of the total quantity of paint, the gellant is present in an amount of about 5% to about 10% by weight of the total quantity of paint, and colored crayon is present in an amount of about 30% to about 55% by weight of the total quantity of paint.

15. The system of claim 14, wherein the activator is present in an amount of about 27% by weight of the total quantity of paint, the solvent is present in an amount of about 27% by weight of the total quantity of paint, the gellant is present in an amount of about 6% by weight of the total quantity of paint, and colored crayon is present in an amount of about 40% by weight of the total quantity of paint.

16. The system of claim 1, wherein the color-changing marking medium is a color-changing marker ink that comprises at least one nonaqueous solvent and a solvent dye.

17. The system of claim 16, wherein the marker ink further comprises a first nonaqueous solvent and a second nonaqueous solvent.

18. The system of claim 17, wherein the activator is 4-(4-isopropoxyphenylsulfonyl)phenol.

19. The system of claim 17, wherein the first nonaqueous solvent is ethanol and the second nonaqueous solvent is isopropanol.

20. The system of claim 16, wherein the solvent dye is present in an amount of about 0.1% to about 1.0% by weight of the marker ink, the activator is present in an amount of about 10% to about 15% by weight of the marker ink, and the at least one nonaqueous solvent is present in an amount of about 84% to about 89.9% by weight of the marker ink.

21. The system of claim 20, wherein the solvent dye is present in an amount of about 0.5% by weight of the marker ink, the activator is present in an amount of about 12% by weight of the marker ink, and the at least one nonaqueous solvent is present in an amount of about 87.5% by weight of the marker ink.

22. The system of claim 21, wherein the at least one nonaqueous solvent includes a first nonaqueous solvent and a second nonaqueous solvent, and wherein the first nonaqueous solvent is present in an amount of about 67% by weight of the marker ink and the second nonaqueous solvent is present in an amount of about 20.5% of the marker ink.

23. The system of claim 22, wherein the first nonaqueous solvent is ethanol and the second nonaqueous solvent is isopropanol.

24. The system of claim 1, wherein the marking medium is a color-changing nail polish and the substrate is an overlay that attaches to a nail.

25. The system of claim 24, wherein the activator is 4-(4-isopropoxyphenylsulfonyl)phenol.

26. The system of claim 24, wherein the color-changing nail polish includes a colored, solvent-based, non-reactive nail polish present in an amount of about 90% to about 95% by weight of the color-changing nail polish, and the activator is present in an amount of about 5% to about 10% by weight of the color-changing nail polish.

27. The system of claim 26, wherein the activator is present in an amount of about 8% by weight of the color-changing nail polish, and the solvent-based, non-reactive nail polish is present in an amount of about 92% by weight of the color-changing nail polish.

28. The system of claim 24, wherein the color-changing nail polish further includes ethyl cellulose, anhydrous isopropanol, and ethanol SDA 40B.

29. The system of claim 28, wherein the ethyl cellulose is present in an amount of about 3.0% to about 5.0% by weight of the color-changing nail polish, the anhydrous isopropanol is present in an amount of about 15% to about 25% by weight of the color-changing nail polish, the ethanol SDA 40B is present in an amount of about 60% to about 65% by weight of the color-changing nail polish, and the 4-(4-isopropoxyphenylsulfonyl)phenol is present in an amount of about 5% to about 20% by weight of the color-changing nail polish.

30. The system of claim 29, wherein the ethyl cellulose is present in an amount of about 3.6% by weight of the color-changing nail polish, the anhydrous isopropanol is present in an amount of about 20% by weight of the color-changing nail polish, the ethanol SDA 40B is present in an amount of about 62.6% by weight of the color-changing nail polish, and the 4-(4-isopropoxyphenylsulfonyl)phenol is present in an amount of about 11.8% by weight of the color-changing nail polish.

31. The system of claim 1, wherein the leuco dye is selected from the group consisting of Copikem 14, Copikem Magenta 20, Copikem 6, Copikem 4, Pergascript Orange I-5R, Pergascript Red I-6B, Pergascript Green I-3G, Pergascript Yellow I-3R, Pergascript I-2RC Reakt Red 448, Reakt Yellow 186, EAB-F, Specialty Magenta 20, Specialty Red 747, Specialty Black 34, Specialty Magenta 16, Specialty Orange 14, Specialty Blue 1, Specialty Cyan 39, and Specialty Yellow 37, and Orange DCF.

32. The system of claim 1, wherein the activator is selected from the group consisting of D8 (4-hydroxy 4-isopropoxy diphenyl sulfone), bisphenol, phenolic resin, alkylphenol novolac resin, zinc chloride, a hydroxybenzoate, 4-(4-isopro-proxyphenylsulfonyl)phenol, "4,4'-Sulfonyldiphenol", zinc salicylate, zincated phenolic resin, reactive acidic clay, o-Benzoic Sulfimide, and o-Hydroxybenzoic acid.

33. The system of claim 1, wherein the at least one non-aqueous solvent is selected from the group consisting of Propylene Carbonate, 2,2,4-Trimethyl 1,3 Pentanediol monisobutyrate, Disiopropyl Adipate, Dimethyl Adipate, C12-15 Alkyl Benzoate, Tri-n-butylcitrate, Octyl Palmitate, Dioctyl Sebacate, Dibutyl Sebacate, Methyl Laurate/Myristate, Triethyl Citrate, Acetyl Triethyl Citrate, Acetyl Tributyl Citrate, Isopropyl Palmitate, and Stearyl Alcohol.

34. A color-changing marking system, comprising:

a color-changing marking medium having a nominal color and including a color former leuco dye that is not soluble in an aqueous solvent and at least one nonaqueous solvent; and a substrate having a treated portion on which a color developer activator has been applied;

wherein application of the color-changing marking medium to an untreated portion of the substrate causes the color-changing marking medium to create marks of the nominal color, and application of the color-changing marking medium to the treated portion of the substrate causes the color-changing marking medium to create marks of a changed color in response to a reaction between the leuco dye and the activator.

35. The system of claim 34, wherein the color-changing marking medium is a crayon.

36. The system of claim 35, wherein the leuco dye is present in an amount of about 0.1% to about 5% by weight of the crayon, the solvent is present in an amount of about 10% to about 30% by weight of the crayon, and colored crayon ingredients are present in an amount of about 65% to about 88.9% by weight of the crayon.

37. The system of claim 36, wherein the leuco dye is present in an amount of about 0.2% by weight of the crayon and the solvent is present in an amount of about 25% to about 30% by weight of the crayon.

38. The system of claim 36, wherein the solvent includes a first solvent and a second solvent.

39. The system of claim 38, wherein the first solvent is present in an amount of about 12.5% to about 15% by weight of the crayon and the second solvent is present in an amount of about 12.5% to about 15% by weight of the crayon.

40. The system of claim 39, wherein the first solvent is present in an amount of about 14.3% by weight of the crayon and the second solvent is present in an amount of about 14.3% by weight of the crayon.

41. The system of claim 38, wherein the first solvent is Tri-n-butylcitrate and the second solvent is Dimethyl Adipate.

42. The system of claim 34, wherein the leuco dye is selected from the group consisting of Copikem 14, Copikem Magenta 20, Copikem 6, Copikem 4, Pergascript Orange I-5R, Pergascript Red I-6B, Pergascript Green I-3G, Pergascript Yellow I-3R, Pergascript I-2RC Reakt Red 448, Reakt Yellow 186, EAB-F, Specialty Magenta 20, Specialty Red 747, Specialty Black 34, Specialty Magenta 16, Specialty Orange 14, Specialty Blue 1, Specialty Cyan 39, and Specialty Yellow 37, and Orange DCF.

43. The system of claim 34, wherein the activator is selected from the group consisting of D8 (4-hydroxy 4-isopropoxy diphenyl sulfone), bisphenol, phenolic resin, alkylphenol novolac resin, zinc chloride, a hydroxybenzoate, 4-(4-isoproproxyphenylsulfonyl)phenol, "4,4'-Sulfonyldiphenol", zinc salicylate, zincated phenolic resin, reactive acidic clay, o-Benzoic Sulfimide, and o-Hydroxybenzoic acid.

44. The system of claim 34, wherein the at least one non-aqueous solvent is selected from the group consisting of Propylene Carbonate, 2,2,4-Trimethyl 1,3 Pentanediol monisobutyrate, Disiopropyl Adipate, Dimethyl Adipate, C12-15 Alkyl Benzoate, Tri-n-butylcitrate, Octyl Palmitate, Dioctyl Sebacate, Dibutyl Sebacate, Methyl Laurate/Myristate, Triethyl Citrate, Acetyl Triethyl Citrate, Acetyl Tributyl Citrate, Isopropyl Palmitate, and Stearyl Alcohol.

45. The system of claim 34, wherein the marking medium is a colored pencil.

46. The system of claim 45, wherein the marking medium includes solvent for solvating the leuco dye in the colored pencil.

47. The system of claim 34, wherein the marking medium is a colored paint.

48. The system of claim 47, wherein the paint includes solvent and gellant.

49. The system of claim 34, wherein the color-changing marking medium is a color-changing marker ink that comprises at least one nonaqueous solvent and a solvent dye.

50. The system of claim 34, wherein the marking medium is a color-changing nail polish and the substrate is an overlay that attaches to a nail.

51. A color-changing marking system, comprising:

a color-changing marking medium having a nominal color, and including a fully or partially solvated color developer activator and an abrasive; and a substrate having a treated portion on which a color former leuco dye and a second color developer activator have been applied;

wherein application of the color-changing marking medium to an untreated portion of the substrate causes the color-changing marking medium to create marks of the nominal color, and application of the color-changing marking medium to the treated portion of the substrate creates marks of a changed color on the treated portion of the substrate in response to both heat generated and a chemical reaction between the color former leuco dye, the second activator, and the fully or partially solvated activator.

52. The system of claim 51, wherein the marking medium is a crayon or colored pencil.

53. The system of claim 52, wherein the abrasive is selected from the group consisting of silica, titanium dioxide, calcium carbonate, clay or talc.

* * * * *